United States Patent [19]

Tomassetti, Jr. et al.

[11] 4,297,814

[45] Nov. 3, 1981

[54] DOME STRUCTURE

[76] Inventors: Jerome Tomassetti, Jr., Box 288, R.D. #1, Canonsburg, Pa. 15317; Adolph F. Lerch, Lynwood Dr., Valencia, Pa. 16059

[21] Appl. No.: 42,810

[22] Filed: May 29, 1979

[51] Int. Cl.[3] ..... E04B 1/32

[52] U.S. Cl. ..... 52/81

[58] Field of Search ..... 52/80, 81, 82, 309.5

[56] References Cited

U.S. PATENT DOCUMENTS 3,290,845 12/1966 Snyder ..... 52/309.5

3,999,337 12/1976 Tomassetti et al. ..... 52/82

FOREIGN PATENT DOCUMENTS 899373 8/1944 France ..... 52/81

625089 9/1961 Italy ..... 52/80

*Primary Examiner*—James L. Ridgill, Jr.

*Attorney, Agent, or Firm*—Buell, Blenko, Ziesenheim & Beck

[57] ABSTRACT

A dome structure having a stabilizer pole forming the apex of the dome. A plurality of spaced riser beams are arched and terminate at the apex and join a plurality of arched panel members. Each of the panel members taper from a wide base to a narrow top at the apex. Each panel member is formed with an interfitting edge flange which attaches to a riser beam through a resilient connection.

5 Claims, 12 Drawing Figures

DOME STRUCTURE

The invention relates to dome structures and in particular to dome structures which may be quickly assembled and disassembled, with stabilizer poles for erecting and stabilizing the dome structure. This application is an improvement on our U.S. Pat. No. 3,999,337 issued Dec. 28, 1976.

Prior art dome structures are complex and lack stability. They are generally difficult to assemble and expensive. The instant invention by the applicants provides a simplified dome structure utilizing a removable erection stabilizer column to provide additional stability to facilitate erection as in our U.S. Pat. No. 3,999,337. In addition, the present invention provides a new edge joint structure in combination with arched curved generally pie-shaped panels, insulated both in the panel and the joint.

Characteristic of prior art dome structures, other than the structure of our earlier U.S. Pat. Nos. 3,999,337 are those set out in Moss patent 3,562,975; Danin patent 3,543,454; McClure patent 1,019,334; Johnson patent 2,820,990; Waling patent 3,389,202; and Canadian patent 577,240 to Janousky. These patents provide structures which require bending of the elements in place (Moss and Johnson) fixed center props (McClure and the Canadian patent) coupled with the necessity of fixed anchoring systems. Such systems are impractical if not inoperative in most situations where dome structures would be desirable.

The structures of this invention are quickly assembled and disassembled. They may be quickly arranged to provide a variety of interior arrangements and they may be assembled as a plurality of units. The new joint structure permits both limited expansion and contraction along with sufficient flexing to absorb shocks of sudden wind gusts and other live loads without structural damage.

Preferably we provide a domed structure which comprises a removable stabilizer pole, a stabilizer ring removably mounted on the top of the stabilizer pole, a plurality of panel members preferably of preformed compound curved arched shape and of generally triangular shape from bottom to top, each having an arched riser beam along one edge removably affixed to the panel member and projecting beyond the edge of the panel forming a flange receiving the edge of the next adjacent panel. A base ring flange on the bottom of each panel is attached to a footer or base defining the area being covered by the dome. The panels are preferably provided at the top with an upstanding flange turned outwardly above the surface of the panel to form a U-shaped ring. Each of the arched panel members preferably has a hook means fixed to the apex of the triangle and adapted removably to engage the stabilizer ring surrounding and fixed to the top of the stabilizer pole. Preferably the arched panel members form, at their apex or top end, a circular opening having a vertically movable dome mounted on the stabilizer ring and movable vertically to open and close the circular opening to provide ventilation. Movable partition means may be removably and rotatably attached to the removable stabilizer pole. Door and window openings may be integrally attached to individual panel members. Preferably the panel members are formed of two spaced apart generally parallel rigid skins, between which is an insulant such as urethane foam.

The opposite sides of each panel member are respectively a pair of interfitting flanges, connected by a ball headed bolt and socket connection, to form a joint along the edges of adjoining panels within a groove and a seal member fitting in said groove to cover said joint and insulate the same.

In the foregoing general description we have set out certain objects, purposes and advantages of our invention. Other objects, purposes and advantages of this invention will be apparent from a consideration of the following description and the accompanying drawings in which.

Figure 1:
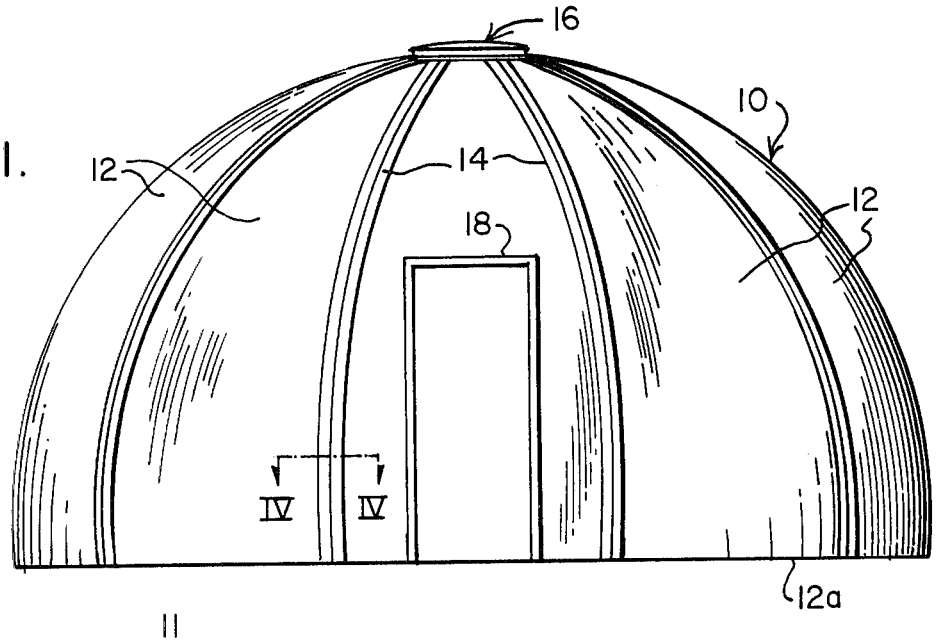
FIG. 1 is a side elevation of a dome structure according to this invention.

Referring to the drawings, FIG. 1 shows a dome structure 10 with a plurality of arched panel members 12. Connecting each of the panel members 12 are arched riser beams 14 fixed to one edge of each panel member by studs 15. The arched panel members 12 and the arched riser beams 14 terminate at an apex generally designated as 16. The arched panel members 12 taper in generally triangular form from a wide base **12*a* to a narrow top at the apex 16. Within one of the panel members 12 is a door frame 18**, which will be described later in more detail.

Figure 4:
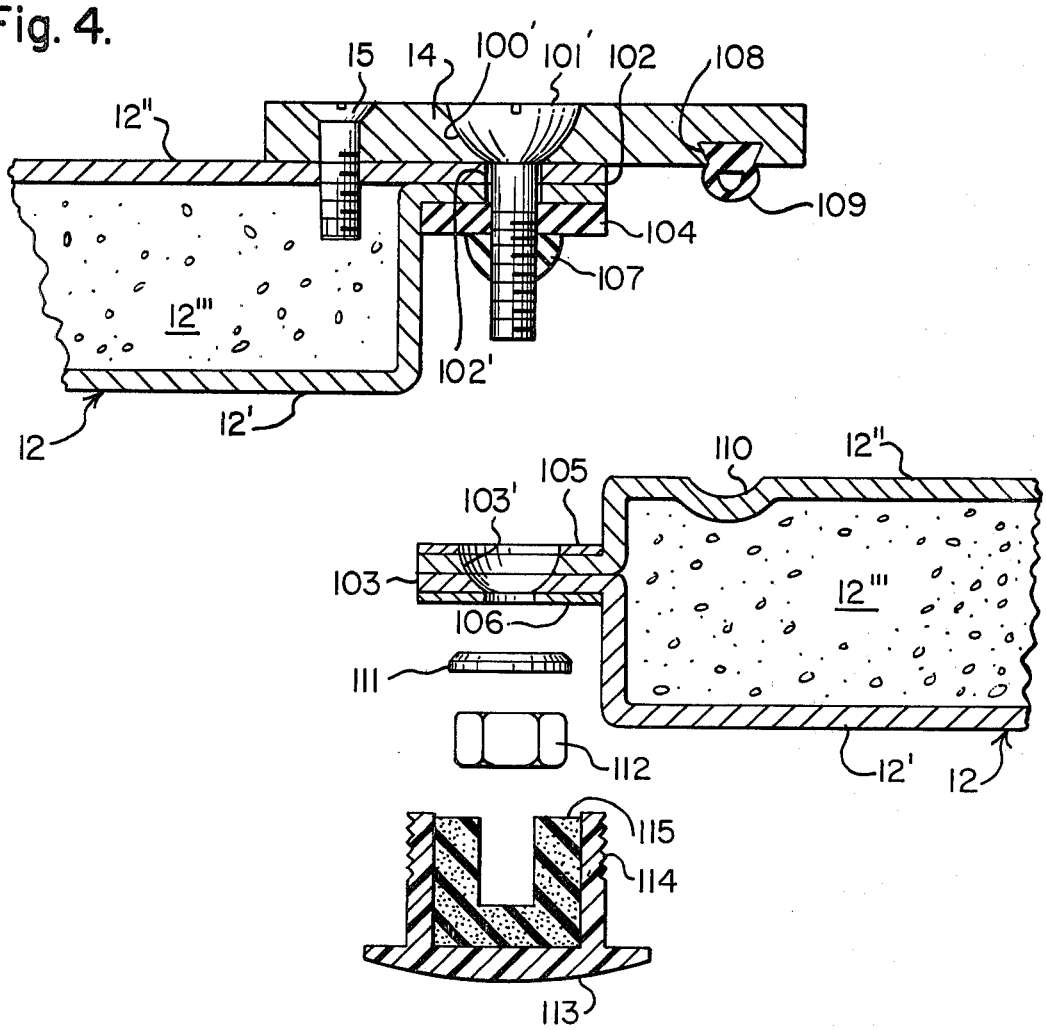
FIG. 4 is an enlarged fragmentary exploded sectional view of the joint taken on the line IV—IV of FIG. 1.
Figure 5:
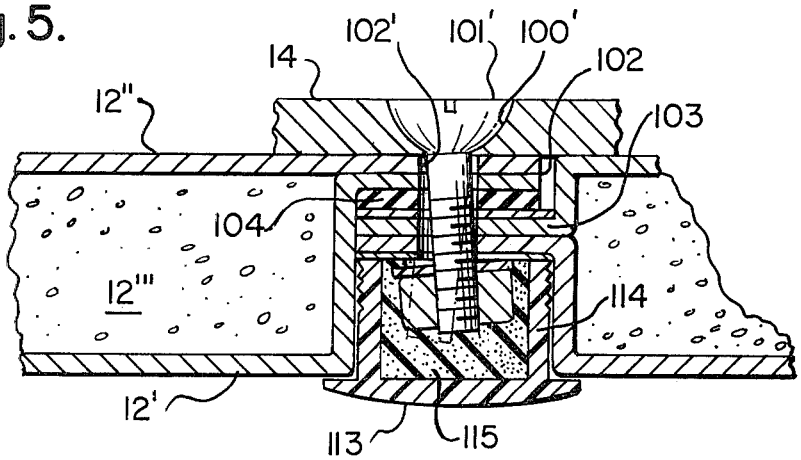
FIG. 5 is an enlarged fragmental sectional view of the joint of FIG. 4 in assembled condition.
Figure 6:
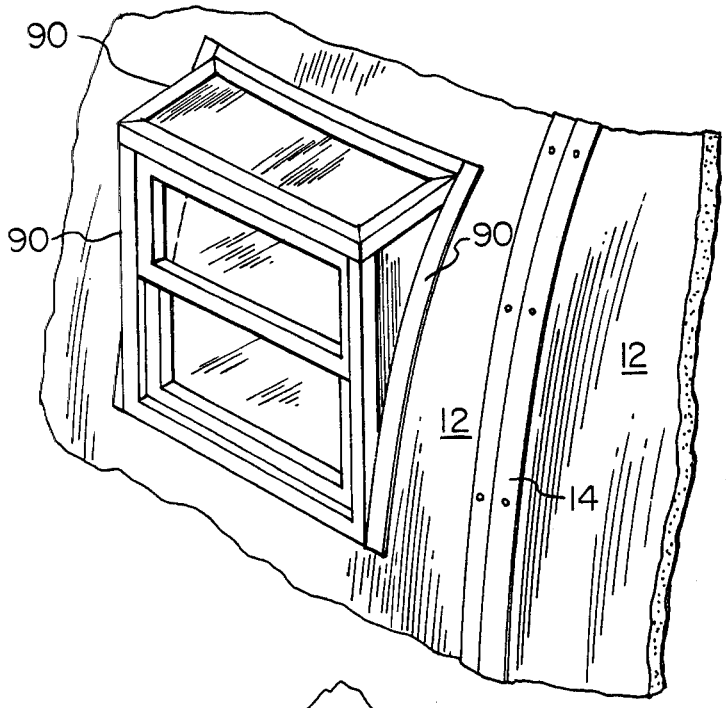
FIG. 6 is an enlarged isometric view of a wall panel, partly cut away, to show the window structure assembly.
Figure 7:
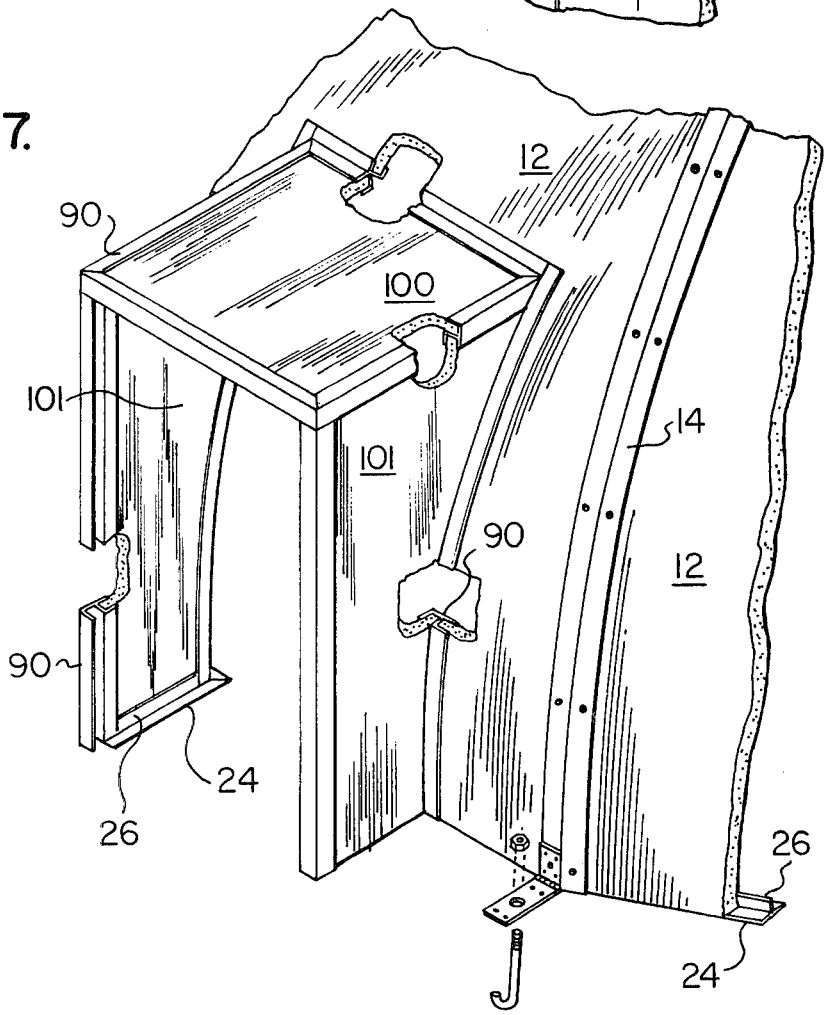
FIG. 7 is an enlarged isometric view of a wall member with entry structure assembly.
Figure 8:
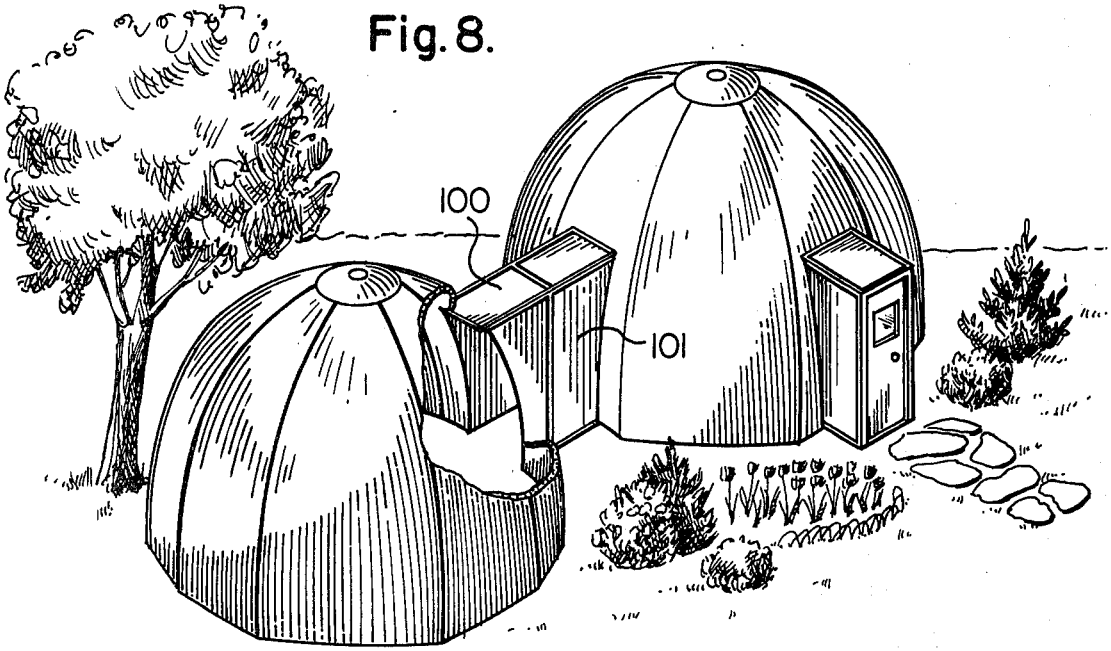
FIG. 8 is an isometric view of a plurality of interconnected domes.

FIG. 4 shows an enlarged view taken on the line IV—IV of FIG. 1, showing a pair of rigid arched panel members 12 joined with a riser beam 14 comprised of a flat plate of arched form and slightly arcuate section fixed to the edge of one panel 12 by studs 15 or similar fasteners. The panel members are formed of inner 12' and outer 12'' skins, spaced apart and with the area between filled with insulant 12''' which may be urethane foam, foamed in place. The formed sections of the arched riser are curved strips of plate of preferably slightly concave form, as mentioned above, although they may be flat arched strips. Each of the riser member 14 has a portion overlapping one edge of the outer skin 12'' and attached thereto by studs 15. A plurality of spaced openings 100', hemispherical in shape, are provided along the center line of riser beams 14, receiving a hemispherical headed bolt 101' which passes through the riser beam and openings 102' in flange 102 fromed by the joining of skins 12' and 12'' along one edge and opening 103' in a second flange 103 formed by joining skins 12' and 12'' along the opposite edge. Flange 102 is separated from flange 103 by a resilient sealing strip 104. Preferably flange 103 is provided with aluminum strips 105 and 106 on each side to act as a load bearing means. The opening 103' in flange 103 is also preferably hemispherically shaped as shown in FIG. 4 to receive a hemispherical rubber seal 107 as illustrated in FIG. 5, although this is not necessary. The riser beam 14 is also preferably provided with a dovetail slot 108 extending along its free edge, carrying a resilient seal 109 which engages a corresponding groove 110 in outer skin 12'' adjacent flange 103. The riser beam 14 and flanges 102 and 103 are held in place by a washer 111 and a nut 112 threaded on bolt 101. An elongate trim cap or strip 113 having depending legs 114, serrated along their bottom edges and filled with foam 115 is frictionally engaged in the groove 116 formed above the connecting flanges 102 and 103 so as to cover the bolt ends 101 and provides a finished internal surface within the structure. This structural arrangement of the joint provides several advantages. First, it permits easy fit of the parts during erection. Second, it accommodates expansion and contraction. Third, it absorbs the shock of sudden wind gusts and other live loads.

Figure 2:
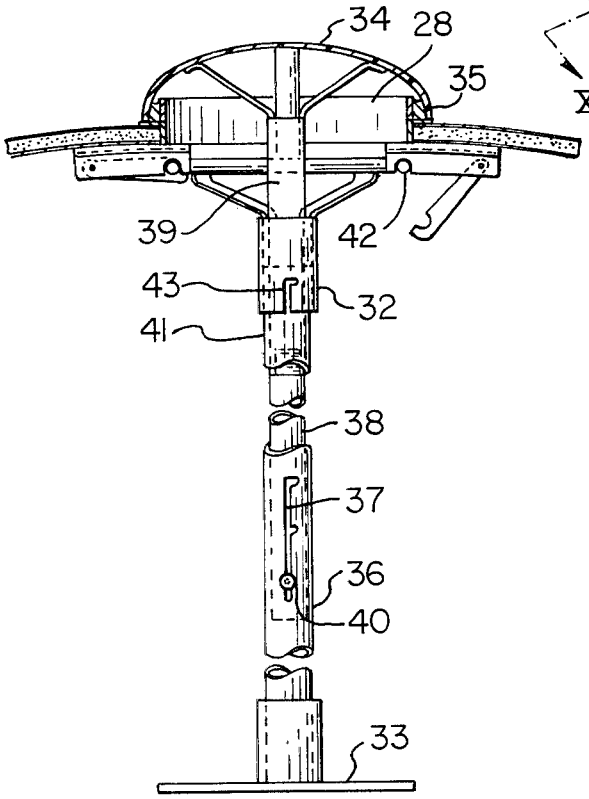
FIG. 2 is a detailed fragmentary elevational view of a stabilizer pole used in assembling the dome structure of this invention.
Figure 3:
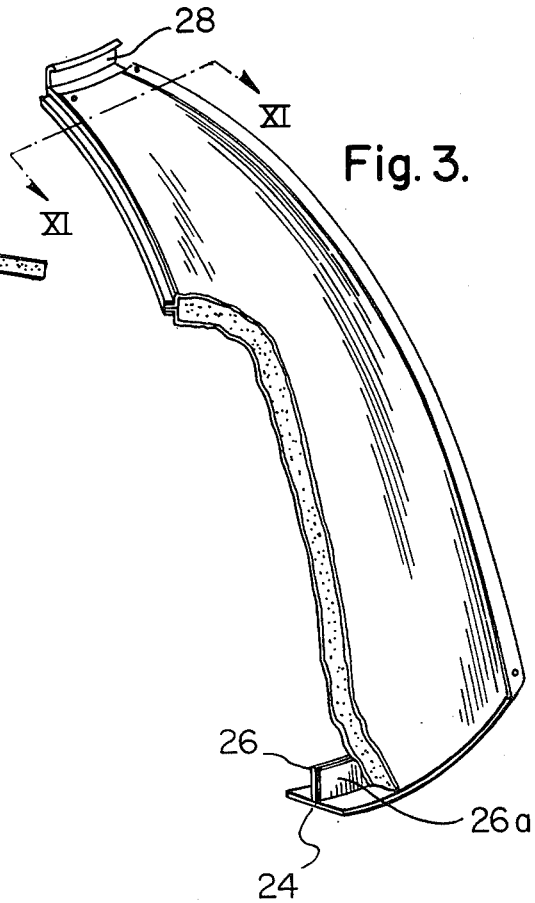
FIG. 3 is a detailed fragmentary vertical sectional view of an arched panel member of this invention.
Figure 12:
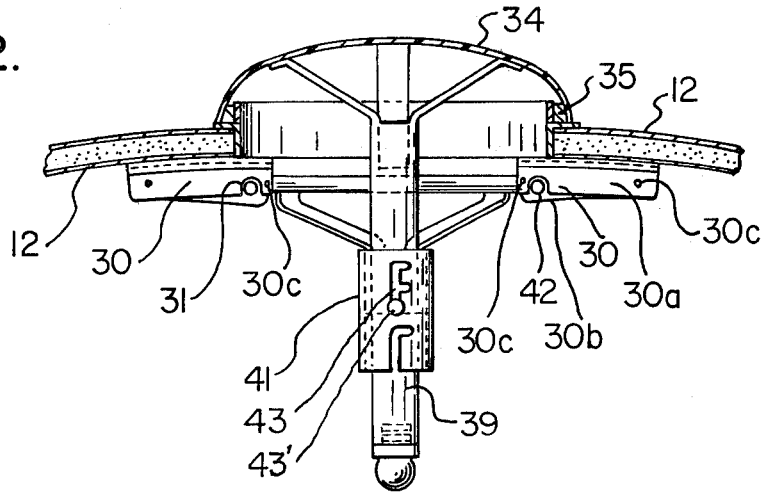
FIG. 12 is a fragmentary section through the top dome structure of this invention with the stabilizer pole removed.
Figure 11:
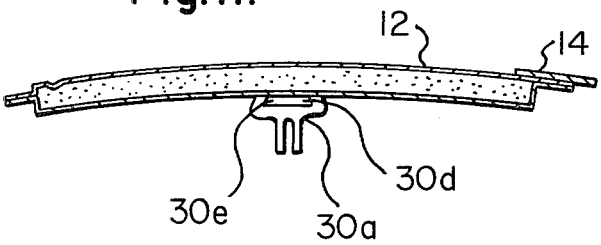
FIG. 11 is a fragmentary section of the integral riser beam and panel structure according to this invention on the line XI—XI of FIG. 3.

Referring to FIG. 3, the arched panel member 12 on its base end is coupled to a T member 24 having a center portion of the T 26. The edge of panel member 12 is bolted to the inside of the top of the T member 24 and one face of the panel 12 abuts the center portion 26 of the T member 24. Preferably the side of the center portion or web of the T in contact with panel 12 is provided with a sealing or weather strip of resilient material such as rubber or neoprene **26*a*. At the upper end of the panel member 12 which terminates at the apex 16, another T member 28 is affixed and provided with a hook member 30. The panel 12 is preferably formed of a resin foam such as urethane foam sandwiched between a solid sheet skin, e.g. aluminum, steel, plastic, on both sides. However, any other suitable material may be used. For example clear acrylic panels could be used to provide a green house or like structure. Inside the dome section, shown in FIG. 1, is a stabilizer pole, generally designated 32 as shown in FIG. 2. The top of the pole 32 has a ventilator cap 34 which forms the apex 16. The stabilizer pole 32 has a shaft 36 with an activator rod 38 inside and coupled to the ventilator cap 34. The shaft 36 has an opening slit with a handle 40 for moving the activator rod 38 up and down, thereby lifting the ventilator cap 34 up or down off its seat formed by a plurality of T sections 28. A neoprene ring 35 seals the ventilator cap 34 with the T sections when it is closed. At the top of the stabilizer pole 32 is a horizontal ring 42 over which hooks 30 engage and hold the panels 12 and the riser 14 to the apex area 16. This is also shown in FIG. 12 which is a top fragmentary view of the risers 14 and the arched panel 12 with hooks 30 coupled through T section 28. A stabilizer base and plate 33 holds the stabilizer pole 32**.

In FIG. 1 we have illustrated the presently preferred form of apex structure for our structure. In this form of structure we provide a dome structure 10 with a plurality of preformed rigid compound curved arched panel members 12 shaped to form a dome whose base 11 is a circle defined by base plates 24 fixed to the bottom or base of each panel member 12. Each of the panel members 12 is connected to the next adjacent panel member by rigid preformed arched riser beams 14 as discussed above. The arched panel members 12 taper in generally triangular form from a wide base **11*a* to a truncated apex 16. A door frame 18 is provided in at least one of each group of panels 12** making up a dome structure according to this invention.

In the embodiment illustrated in FIG. 12 we also provide a removable stabilizer pole 32 and a stabilizer ring 42 mounted thereon as described above. The stabilizer pole has an internal movable shaft 38 and handle 40 movable in a locking guide slot 37. The movable shaft 38 engages the bottom end of a similar movable shaft 39 within center post 41 of the stabilizer ring. The movable shaft 39 also has a separate handle 43' movable in locking guide slot 43. The shaft 39 carries a ventilator cap 34 which moves vertically with the shaft up and down off its seat 28. Movement of either shaft 39 or 38 will cause this movement of cap 34 because so long as stabilizer pole 32 is in place, shaft 38 engages the lower end of shaft 39.

Each of the compound curved preformed panel members has a locking hook 30 which engages stabilizer ring 42 to hold the ring and panels in fixed integral position. The locking hook 30 may be in the form of a base **30*a* and locking member 30*b* engaging the ring 42 in cooperating slots 31 which surround the ring 42. The locking member 30*b* is fixed in base 30*a* by bolt 30*c*. Other similar or equivalent locking arrangements may, of course, be used. The base 30*a* is provided with a dovetail groove 30*d* which engages a dovetail rail 30*e*** on the inside of the panel member.

Figure 9:
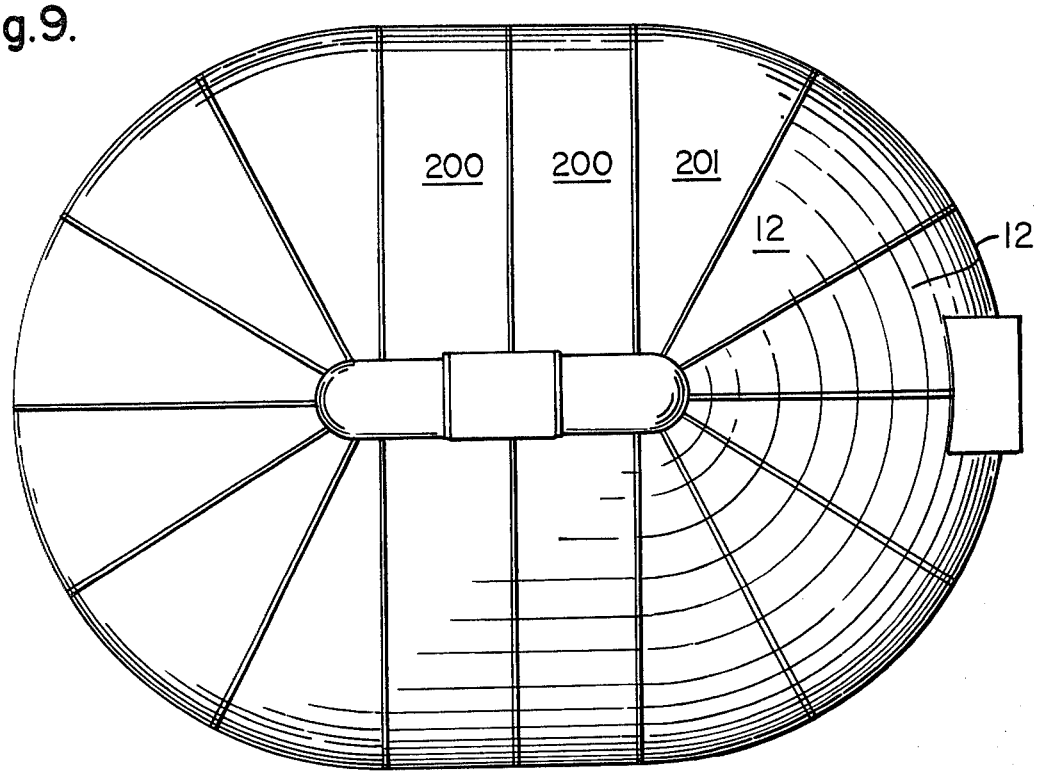
FIG. 9 is a top plan view of an elongate dome structure according to this invention.
Figure 10:
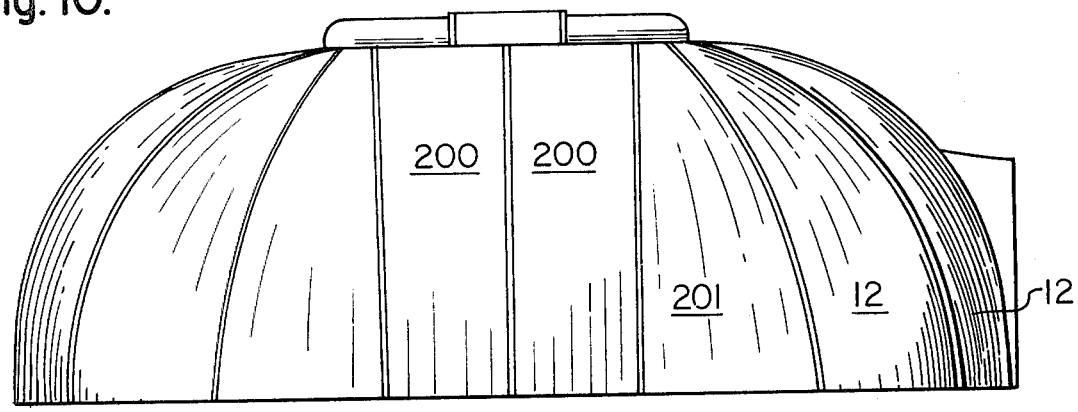
FIG. 10 is a side elevational view of the elongate dome structure of FIG. 9.

In our preferred embodiment door and window openings are formed in selected panels by Y shaped panel holders 90 and properly formed filler panels. The filler panels for doorways are preferably formed in three interfitting pieces, a top 100 and sidewalls 101. Each sidewall is cut at each vertical side to a curve corresponding to that of the panel so that it can directly connect two adjacent domes. Each of the top 100 and sidewall members 101 are adapted to fit into panel holders 190.

Where it is desired to form an elongate dome structure, as illustrated in FIGS. 9–10, two half dome structures are connected by parallel sided arcuate panels 200 and transition panels 201. In such a structure two support or stabilizer poles 32 are preferably used and rings 42 are connected by straight rods 202 attached tangentially thereto to receive locking hooks 30 on each separate panel 200 and 201.

In the foregoing specification we have set out certain preferred practices and embodiments of this invention. However, it will be understood that this invention may be otherwise embodied within the scope of the following claims.

We claim:

1. A dome structure comprising:

(a) a base;

(b) a plurality of side by side preformed and pre-arched panel members, at least a part of which taper from a wide base to a narrow top forming an apex;

(c) a stabilizer ring mounted on a removable stabilizer pole forming an apex of a dome spaced from the base;

(d) a pair of interfitting flanges on the opposite sides of each preformed and pre-arched panel member;

(e) an arched riser beam fixed to one side of each panel member adjacent one of said flanges;

(f) resilient connecting means engaging and joining said riser beam and a pair of interfitting flanges on each adjacent pair of panel members for connecting the same together;

(g) releasable locking means between the stabilizer ring and each panel member, releasably fastening each said panel member to said stabilizer ring;

(h) the flange on one side of the panel members forming an extension of the outer skin and the flange on the other side of the panel members lying intermediate the inner and outer skin and generally parallel therewith;

(i) the connecting means including a plurality of hemispherical headed bolts fitting in a hemispherical hole in the riser beam and passing through openings in the interfitting flanges and a resilient member between said interfitting flanges over their entire length; and (j) an elongate trim cap frictionally engaging the bolts and panel members opposite the riser beam.

2. A dome structure comprising:

(a) a base;

(b) a plurality of side by side preformed and pre-arched panel members, at least a part of which taper from a wide base to a narrow top forming an apex;

(c) a stabilizer ring mounted on a removable stabilizer pole forming an apex of a dome spaced from the base;

(d) a pair of interfitting flanges on the opposite sides of each preformed and pre-arched panel member;

(e) an arched riser beam fixed to one side of each panel member adjacent one of said flanges;

(f) resilient connecting means engaging and joining said riser beam and a pair of interfitting flanges on each adjacent pair of panel members for connecting the same together;

(g) releasable locking means between the stabilizer ring and each panel member, releasably fastening each said panel member to said stabilizer ring; and (h) said connecting means including a plurality of hemispherical headed bolts fitting in a hemispherical hole in the riser beam and passing through openings in the interfitting flanges and a resilient member between said interfitting flanges over their entire length.

3. A dome structure comprising:

(a) a base;

(b) a plurality of side by side preformed and pre-arched panel members, at least a part of which taper from a wide base to a narrow top forming an apex;

(c) a stabilizer ring mounted on a removable stabilizer pole forming an apex of a dome spaced from the base;

(d) a pair of interfitting flanges on the opposite sides of each preformed and pre-arched panel member;

(e) an arched riser beam fixed to one side of each panel member adjacent one of said flanges;

(f) resilient connecting means engaging and joining said riser beam and a pair of interfitting flanges on each adjacent pair of panel members for connecting the same together;

(g) releasable locking means between the stabilizer ring and each panel member, releasably fastening each said panel member to said stabilizer ring;

(h) the flange on one side of the panel members forming an extension of the outer skin and the flange on the other side of the panel members lying intermediate the inner and outer skin and generally parallel therewith; and (i) said connecting means including a plurality of hemispherical headed bolts fitting in a hemispherical hole in the riser beam and passing through openings in the interfitting flanges and a resilient member between said interfitting flanges over their entire length.

4. A dome structure as claimed in claim 1 or 2 or 3 wherein each panel member is made up of spaced inner and outer skins joined along their edges and having the space between filled with foamed in situ insulant.

5. A dome structure as claimed in claim 2 wherein an equal number of panel members having parallel sides are positioned on opposite sides of said stabilizer ring between equal numbers of panel members which taper from a wide base to a narrow top whereby to form an elongate dome.

* * * * *